US005217351A

United States Patent [19]

Meier et al.

[11] Patent Number: 5,217,351

[45] Date of Patent: Jun. 8, 1993

[54] SMALL FAN

[75] Inventors: Peter Meier, Lindau; Ernst Scherrer, Greifensee, both of Switzerland

[73] Assignee: Micronel AG, Switzerland

[21] Appl. No.: 656,158

[22] PCT Filed: Jan. 18, 1991

[86] PCT No.: PCT/CH90/00223

§ 371 Date: Apr. 19, 1991

§ 102(e) Date: Apr. 19, 1991

[87] PCT Pub. No.: WO91/05169

PCT Pub. Date: Apr. 18, 1991

[30] Foreign Application Priority Data

Sep. 29, 1989 [CH] Switzerland ..... 3540/89

[51] Int. Cl.[5] ..... F01D 5/02

[52] U.S. Cl. ..... 415/219.1; 415/220

[58] Field of Search ..... 415/182.1, 119, 219.1, 415/220

[56] References Cited

U.S. PATENT DOCUMENTS

| | | | |
|---|---|---|---|
| 420,470 | 2/1890 | Seymour, Jr. | 415/219.1 |
| 4,335,646 | 6/1982 | Jacquet et al. | 415/220 |
| 4,371,313 | 2/1983 | Burgbacher et al. | 415/206 |
| 4,413,947 | 11/1983 | Seki | 415/220 |
| 4,482,302 | 11/1984 | Grignon | 415/220 |
| 4,504,751 | 3/1985 | Meier . | |
| 4,603,271 | 7/1986 | Maruyama et al. | 416/169 A |
| 4,886,415 | 12/1989 | Engelberger et al. | 415/119 |
| 4,909,711 | 3/1990 | Burgbacher et al. | 415/219.1 |
| 4,927,328 | 5/1990 | Scoates et al. | 415/220 |
| 5,096,373 | 3/1992 | Struve et al. | 415/219.1 |

FOREIGN PATENT DOCUMENTS

| | | | |
|---|---|---|---|
| 0180176 | 5/1986 | European Pat. Off. . | |
| 1503483 | 2/1970 | Fed. Rep. of Germany . | |
| 2327125 | 12/1974 | Fed. Rep. of Germany | 415/121.2 |
| 2944183 | 5/1980 | Fed. Rep. of Germany . | |
| 1177794 | 4/1959 | France . | |

*Primary Examiner*—John T. Kwon

*Attorney, Agent, or Firm*—Webb, Burden, Ziesenheim & Webb

[57] ABSTRACT

The small fan has an air conduction housing (2) of plastic, in which an impeller (1) is rotatably supported. It is designed as a meridian-accelerated fan. The blades (1*a*) of the impeller (1) are not twisted and have the same angle of pitch over the entire blade length. The leading edges of the impeller (1*b*) and the front side of the hub (1*c*) as well as the front side of the housing (2*d*) lie approximately in the same plane. In contrast to axial fans, the meridian-accelerated fan has a higher power density along with a lower noise development.

7 Claims, 2 Drawing Sheets

SMALL FAN

The invention concerns a small fan according to the introductory portion of the independent patent claim 1.

A small fan of this type has been disclosed by the applicant through U.S. Pat. No. 4,504,751. The applicant took on the task of improving this fan so that it has a higher capacity with the same outside dimensions and at the same time is quieter and can be produced more cost-favorably. In contrast to the above fan, which is a small axial blower, the small fan according to the invention presents an approximately laminar throughflow. Because essentially no turbulence develops in the air flowing through, it is considerably quieter. An improvement that has long been desired in this area is thus achieved.

Tests have now shown that with the invention fan the power density is ca. 30% higher, compared with the one axial fan. Although it has long been know that meridian-accelerated blowers have a favorable power density, this knowledge had not yet influenced the construction of small fans. It is essential that the blades of the impeller are not twisted and have the same angle of pitch over the entire blade length. The impeller can thus be produced in one piece with simple removal from the mold and thus cost-favorably in the injection molding process.

Through the combination of the essential features of the invention, a fan with more favorable operating characteristics is thus obtained in a simple production process.

A particularly flat construction with a favorable power density is achieved according to a further refinement of the invention in that the leading edges of the impeller and the front side of the hub as well as the front side of the housing lie approximately in the same plane.

An exemplary embodiment of the invention is elucidated in greater detail with respect to the drawings.

Figure 4:
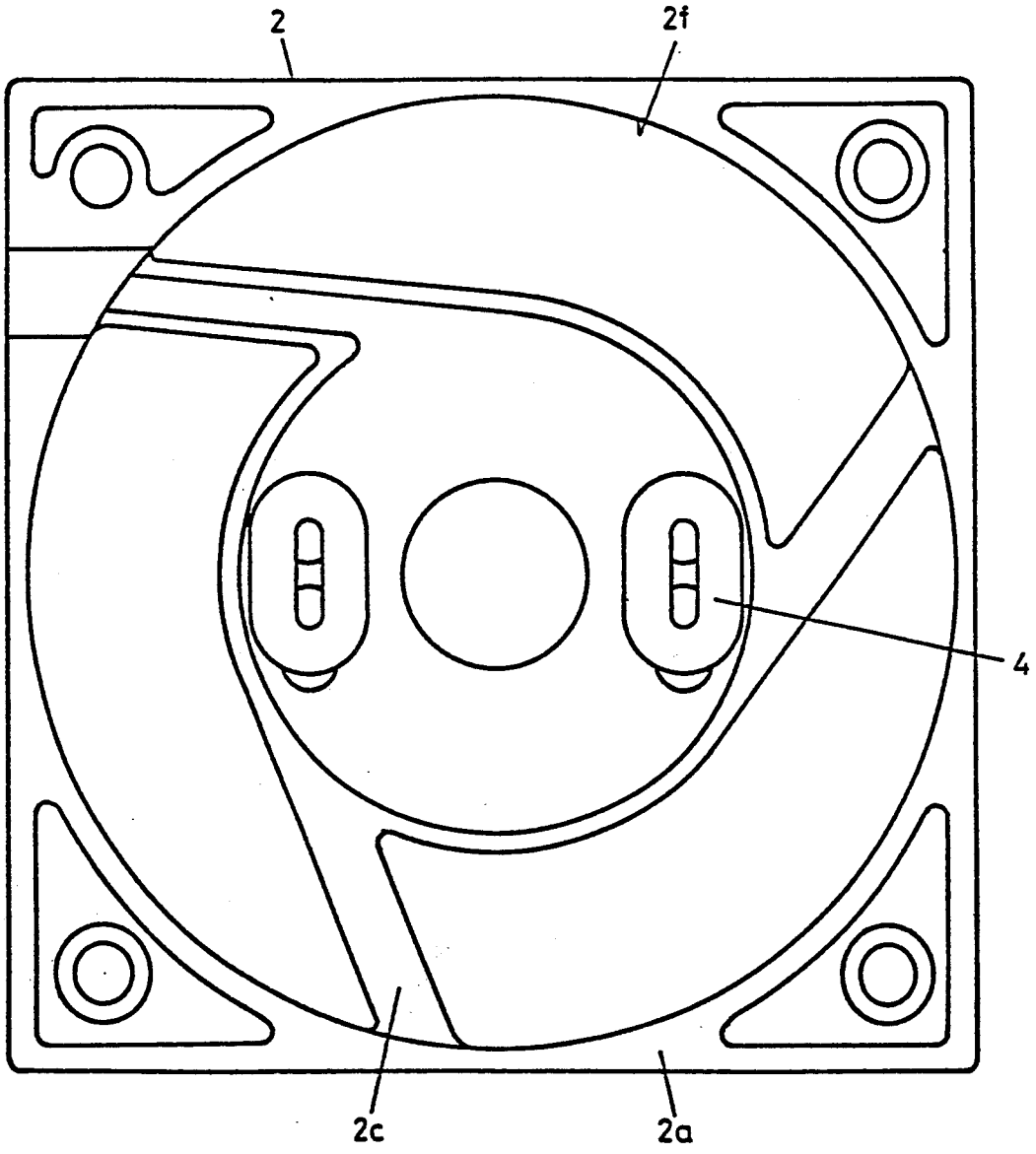

And FIG. 4 shows a view of the air conduction housing.

The small fan has a quadratic air conduction housing 2 with an outside part 2*a* and a circular recess 2*f*. A familiar electric motor 4 with electromagnet coils 4*a* is installed on a shaped bottom 2*b*. The electric motor 4 is connected with the outer part of the housing 2*a* with arms 2*c*.

An impeller 1 of plastic is inserted into the recess 2*f* and supported rotatably in the housing 2 by means of a shaft 3 and a bearing 6. The shaft 3 connected solidly with the impeller 1 is surrounded by an annular permanent magnet 5, which forms a component of the electric motor 4.

Figure 1:
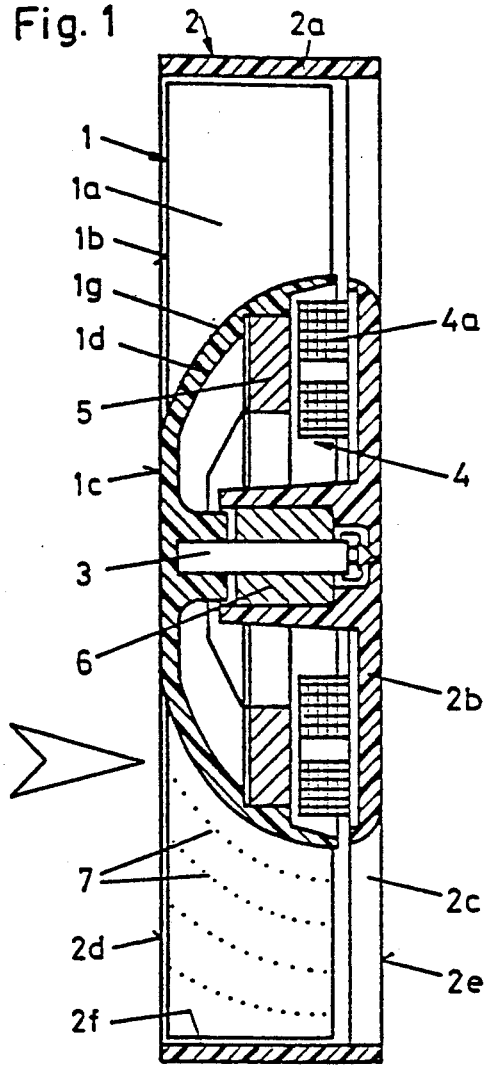
FIG. 1 shows a section through a small fan according to the invention.
Figure 2:
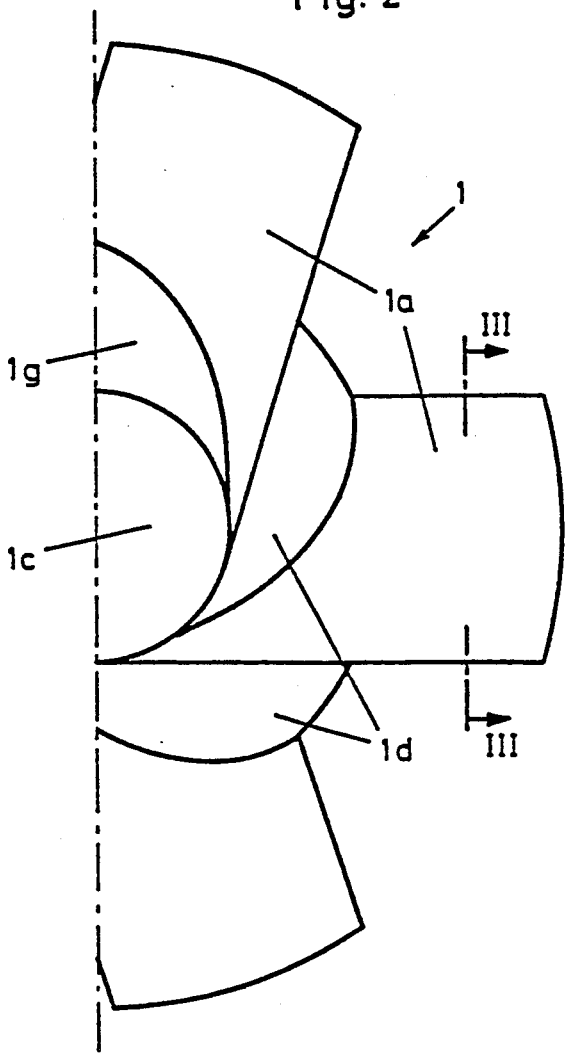
FIG. 2 shows a partial view of an impeller.
Figure 3:
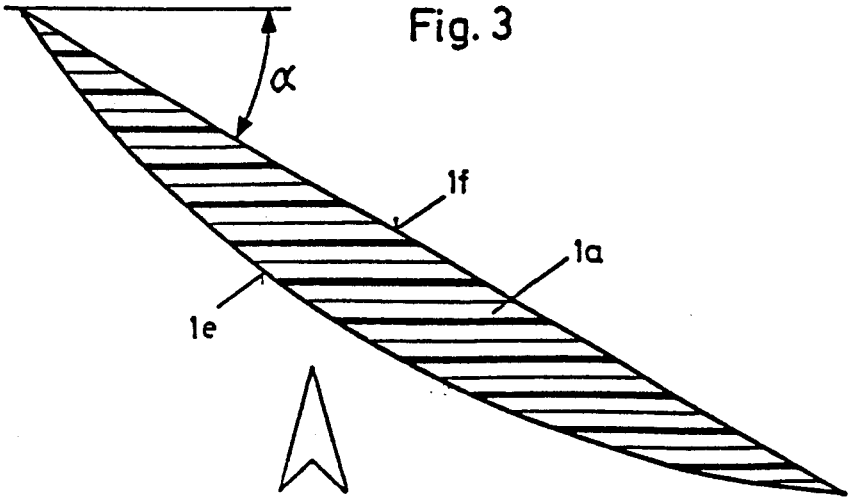
FIG. 3 shows a section through a blade along the line III—III in FIG. 2.

As is evident from FIGS. 2 and 3 in particular, the impeller 1 preferably has five shaped blades 1*a*, which have the same angle of pitch $\alpha$ and thus parallel vane edges (FIG. 3) over the entire blade length. It turned out that with a number of blades between 3 and 7 a particularly favorable ratio between volume flow and noise is achieved. The blades are not twisted and have the same cross section as shown in FIG. 3 up to their point of attachment. The angle of pitch is preferably ca. 30°. In the representation according to FIG. 1 the air enters the fan axially through the front side of the housing 2*d* and leaves it also in the axial direction through the rear side of the housing 2*e*. The flow to the runner and the outflow are thus essentially axial. The impeller 1 is on the other hand traversed diagonally as indicated by the flow lines 7.

The hub 2*d* of the impeller has a flat front surface 1*c*, which lies approximately in a plane with the front side of the housing 2*d* and the leading edges of the blades 1*b*. The flow surface 1*e* of the hub 1*d* connected to the surface 1*c* has the shape shown in FIG. 1. The flow surface 1*e* and 1*f* of the blades 1*a* are evident from the section according to FIG. 3. The hubs and blades are designed so that the air flow through the housing is laminar and essentially no pressure differences arise at the blades in the radial direction.

We claim:

1. Small fan with a quadratic and flat air conduction housing, in which an impeller having a hub and blades including leading edges and rear edges driven by an electric motor is located and through the front side of which air enters and through the rear side of which air exits, characterized in that it is a meridian-accelerated fan, wherein the blades of the impeller are not twisted and have the same angle of pitch over the entire length of the blades, the hub of the impeller having a front surface which lies approximately in a plane with a front side of the housing and the leading edges of the blades, and a flow surface of the hub being convexly curved from the front surface to the rear edges of the blades, the hub being smallest near the front surface, the blades having the same cross section up to their point of attachment and the edges of each blade being parallel to each other, the leading edges of the impeller blades, the front side of the hub, and the front side of the housing lying approximately in the same plane.

2. Small fan according to claim 1, characterized in that the impeller (1) is produced in one piece.

3. Small fan according to claim 2, characterized in that the number of blades is preferably three to eleven.

4. Small fan according to claim 2, characterized in that the impeller is produced of plastic.

5. Small fan according to claim 1, characterized in that the number of blades is preferably three to eleven.

6. Small fan according to claim 1, characterized in that the impeller is produced of plastic.

7. Small fan according to claim 4, characterized in that the number of blades is preferably three to eleven.

* * * * *